United States Patent [19]

Jordan et al.

[11] 4,037,108

[45] July 19, 1977

[54] ION SOURCE WITH CAPABILITY OF CHANGING BETWEEN OPERATION MODES

[76] Inventors: Helmut Jordan, Njupkarrsvagen 94, Tyreso; Curt Sivers, Heleneborgsgatan 12, Stockholm, both of Sweden

[21] Appl. No.: 665,290

[22] Filed: Mar. 9, 1976

[30] Foreign Application Priority Data

Apr. 3, 1975 Sweden ..... 7503809

[51] Int. Cl.[2] ..... H01J 27/00

[52] U.S. Cl. ..... 250/427

[58] Field of Search ..... 250/427, 423, 424

[56] References Cited

U.S. PATENT DOCUMENTS

| | | | |
|---|---|---|---|
| 3,555,272 | 1/1971 | Munson et al. | 250/424 |
| 3,886,365 | 8/1973 | Kruger et al. | 250/423 |

*Primary Examiner*—Alfred E. Smith
*Assistant Examiner*—T. N. Grigsby
*Attorney, Agent, or Firm*—George H. Mitchell, Jr.

[57] ABSTRACT

A combined ion source capable of operating either in an electron-impact-ionization mode or in a chemical ionization mode and being quickly shiftable from one mode to the other, consists of a cavity into which either a sample gas can be introduced to be ionized alone or together with a reaction gas introduced into the cavity, the cavity having at least one opening for the introduction of ionizing particles, or radiation, into the cavity and another opening for the discharge of ions, with a flexible band covering the exterior surface of the cavity between the openings, the band having suitable patterns of openings, each of which patterns cooperates with the various openings to provide a specific combination of openings and at the same time adjusting the width of each opening used in each combination.

4 Claims, 2 Drawing Figures

ION SOURCE WITH CAPABILITY OF CHANGING BETWEEN OPERATION MODES

Figure 1:
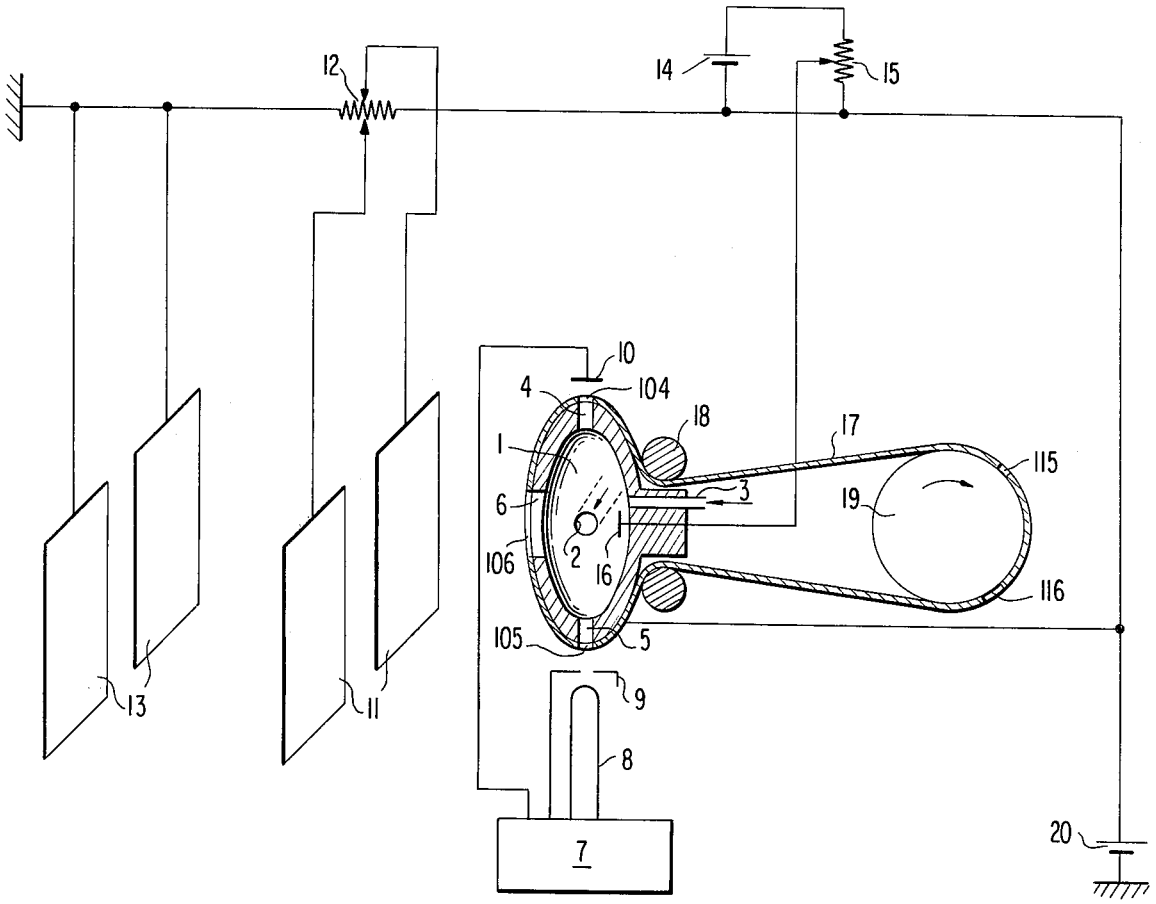

The present invention refers to an ion source consisting of a cavity and means for supplying the gas to be ionized, an output slot for the ions generated in the ion source and at least one slot through which ionizing particles or radiation can impinge into the cavity. The ion source is mainly to be used in a mass spectrometer to permit alternative use of so called chemical ionization and electron-impact-ionization.

In a mass spectrometer a sample-gas is analysed by ionizing the molecules of the gas and letting a beam of positive ions pass through a mass-number-separating device and thereafter the beam is transferred to a detecting device so as to make it possible to register the amount of ions of different masses.

In order to generate ions from a gaseous sample one has usually used the electron-impact-principle. Thereby an electron beam is made to pass through a cavity in which the sample to be investigated has been introduced. One thereby obtains ionized molecules, usually positively charged ions e.g. molecules having lost one or several electrons as well as positively charged parts of sample molecules, so called fragments. The dissociation into fragments thereby takes place according to certain empirically found rules and thus the fragments give an indication of the structure of the molecule. For certain compounds, however, the fragmentation is so complicated that it is difficult to determine the molecular weight with any accuracy. In those cases it is desirable to use some additional ionization method which is softer and therefor gives less fragmentation. Such method is the so called chemical ionization. In this process the sample is subject to impacts from ions of another gas, a so called reaction gas the ions of which thereby will form a complex with the sample molecules. In addition to that one will obtain a certain, although a rather small, fragmentation. An often used reaction gas is methane which in the ion source is ionized by means of an electron impact. The ions thus formed from the reaction gas will react with the sample molecule and give rise among other things to a quasi-molecule-ion with the massnumbers $M+1$ or $M-1$ where M is the molecular weight of the sample.

The ion source is designed as a cavity wherein the reaction gas and the sample, possibly carried by a carrier gas, is introduced. Furthermore an electron beam is introduced into the cavity. The ions generated are withdrawn from the cavity through a slot by means of a statical field from extraction- and/or repelling plates and is shaped to a beam which by means of focusing plates kept on a suitable potential. In order to obtain a sufficient number of ions of the reaction gas its pressure must be in the size 1 torr. Outside the source the pressure should be not higher than $10^{-3}$ torr and in the analyser of the mass spectrometer the pressure should be in the order of $10^{-6}$ torr. In chemical ionization furthermore the slots of the ion source have to be as narrow as possible in order to restrict the flow of reaction gas. In electron-impact-ionization on the other hand considerably broader slots could be used in order to make it possible to extract as many as possible of the generated ions.

Because of the fact that electron-impact-ionization and chemical ionization are completely different it is desirable to use one and the same ion sourc alternatively for both these ionization-procedures and to change between the operation modes fast and simply. A number of proposals for such combined ionization sources have also been shown for instance in Review of Scientific Instruments, Vol. 45, Nr, 10, Oct. 1974, pp 1208–1211. The drawback of the devices hitherto presented is, however, that they are very complicated and expensive in their design. It is an object of the present invention to provide an ion source wherein the switching from chemical ionization to electron-impact-ionization is performed in a fast and uncomplicated way and also to obtain a device of a very simple mechanical design.

The characteristics of the invention will appear from the attached claims.

Figure 2:
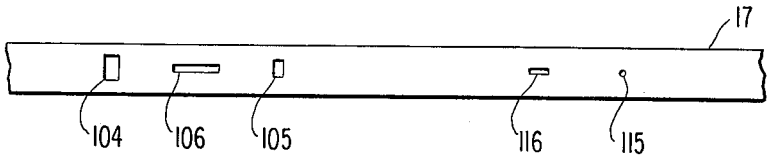

The invention will now be described in detail reference being made to the enclosed drawing; in which FIG. 1 is a schematic representation of a preferred form of the invention, and FIG. 2 is a fragmentary view of the movable band shown in FIG. 1.

In the drawing reference 1 denotes a cavity which forms the ion source to which the gas to be ionized is supplied via a tube at 2. The ion source is furthermore provided with a number of slots 4, 5 and 6 the function of which will be explained below. According to the invention the ion source 1 is surrounded by a band 17 which by means of rollers 18 and 19 is kept tight to the ion source. The band 17 can be moved along the outer surface of the ion source by means of turning the roller 19 and is provided with a number of different combinations of holes so that by suitable positioning of the band one or more of the slots 4, 5 or 6 can be opened and/or be given different widths. Suitably the tnesion of the band is thereby somewhat reduced when the band is moved.

When the ion source according to the drawing is to be used for electron-impact-ionization , the band 17 is turned by means of the roller 19 so that the respective holes 104, 105, and 106 in the band are positioned opposite to the slots 4, 5 and 6 whereby the hole 106 at the slot 6 is relatively big. The sample gas supplied to the ion source via the tube 2 is then subject to an electron beam which is generated by means of a filament 8 and an electrode 9 supplied from a power supply 7. The electron beam is then led towards an electrode 10. By means of the electron beam the sample gas is ionized usually in such a way that electrons are removed from the sample molecules whereby positively charged sample ions are generated. These ions are withdrawn from the ion source through the slot 6 by means of an elcetrode 16 which via a potentiometer 15 and a voltage source 14 is kept on a positve potential. Furthermore the ion source itself is connected to the positive terminal of a voltage source 20 whereby the ion source is given a higher potential than two focusing plates 11 which are connected to a potentionmeter 12, the ionbeam being directed between both these plates and being forcused horizontally. Normally there is also arranged a corresponding pair of plates for vertical focusing. The ion beam is then directed between two grounded electrodes 13 and from thereon the analysing part of the mass spectrometer (not shown in the drawing). The system shown in the drawing is located in vacuum and the pressure in the ion source is at electron-impact-ionization about $10^{-4}$ torr whereas the surrounding area has a pressure of about $10^{-6}$ torr.

When using the ion source according to the drawing for chemical ionization the band 17 is turned to move the holes 115 and 116 into alignment with slots 5 and 6, respectively, so that the slot 5 is still open but having a reduced width, the slot 4 is closed and the slot 6 is open but is having a considerably narrower width than at electron-impact-ionization. Furthermore the ion source is provided with a reaction gas, e.g. methane via a tube 3 in addition to the supply of sample gas. The electron beam will then ionize the reaction gas and form positive ions which react with the sample gas and give rise to the above discussed molecular ions,, which, in the same way as in electron-impact-ionization, will be withdrawn from the ion source between the pairs of plate 11 and 13. The reason for having a considerably narrower slot-width at the slot 5 and 6 in chemical ionization is that in chemical ionization a considerably bigger difference between the pressure in the ion source and the surrounding area is desired. Suitable values are about 1 torr in the ion source and about $10^{-4}$ torr in the surrounding area.

According to the invention one will thus obtain an ion source where different slots of the ion source are closed or given different widths in a very simple way. Furthermore the control is very simple and the sealing problems are reduced since only one axis from the roller 19 has to be led out from the vacuum area.

It should be pointed out that the band could be provided with more than two combinations of holes. For instance it could be desirable to bombard the sample with other particles or other radiation than electrons whereby one suitably arranges a separate slot in the ion source through which this radiation can be applied and a combination of holes in the band which permits opening of suitable slots.

We claim

1. Ion source consisting of a cavity and means for supplying the gas to be ionized, an output slot for the ions generated in the ion source and at least one slot through which ionizing particles or radiation can impinge into the cavity, characterized in, that a displaceable band is stretched across the slots of the ion source, whereby the band is provided with a number of combinations of holes so that by suitable adjustment of the band different combinations of slots can be opened and/or be given different widths.

2. Ions source according to claim 1, characterized in, that the cavity is provided with a third slot through which electrons can be withdrawn from the ion source and that the band is provided with at least two combinations of holes, the first of which having three holes which permit all three slots to be opened and the other one has two holes which permitts that the third slot could be closed whereas the other two are kept open.

3. Ion source according to claim 2, characterized in, that in the two combinations of holes, the holes corresponding to the exit-slot have different widths.

4. Ion source according to claim 1, characterized in, that the outer surface of the ion source is convex whereby a good sealing is obtained against the ban stretched across the surface.

* * * * *